US008316989B2

(12) United States Patent
Bamberg et al.

(10) Patent No.: US 8,316,989 B2
(45) **Date of Patent: *Nov. 27, 2012**

(54) UNIVERSAL BELAY DEVICE

(75) Inventors: Eberhard Bamberg, Salt Lake City, UT (US); Nathaniel Young, Salt Lake City, UT (US)

(73) Assignee: The University of Utah Research Foundation, Salt Lake City, UT (US)

( * ) Notice: Subject to any disclaimer, the term of this patent is extended or adjusted under 35 U.S.C. 154(b) by 212 days.

This patent is subject to a terminal disclaimer.

(21) Appl. No.: 12/616,962

(22) Filed: Nov. 12, 2009

(65) Prior Publication Data

US 2010/0116588 A1 May 13, 2010

Related U.S. Application Data

(63) Continuation-in-part of application No. 11/381,991, filed on May 5, 2006, now Pat. No. 7,757,812.

(60) Provisional application No. 60/677,961, filed on May 5, 2005.

(51) Int. Cl.
*A62B 35/00* (2006.01)

(52) U.S. Cl. ..... 182/5; 182/193

(58) Field of Classification Search ..... 182/5, 191–193, 182/241; 188/65.1–65.5; 24/136 R–136 B
See application file for complete search history.

(56) References Cited

U.S. PATENT DOCUMENTS

| | | | | |
|---|---|---|---|---|
| 55,053 | A * | 5/1866 | Brown et al. | 188/65.3 |
| 542,641 | A * | 7/1895 | Hembacher | 188/65.5 |
| 586,173 | A * | 7/1897 | Frahm | 182/193 |
| 1,924,438 | A * | 8/1933 | Kemper et al. | 24/136 A |
| 2,632,932 | A * | 3/1953 | Blake | 24/136 A |
| 3,709,071 | A * | 1/1973 | Moransais | 81/487 |
| 4,442,918 | A | 4/1984 | Rhoads | |
| 4,502,668 | A | 3/1985 | Dodge | |
| 4,542,884 | A | 9/1985 | Dodge | |

(Continued)

FOREIGN PATENT DOCUMENTS

FR 2554102 10/1983

(Continued)

OTHER PUBLICATIONS

U.S. Appl. No. 11/381,991, mailed Apr. 1, 2008, Office Action.

(Continued)

*Primary Examiner* — Alvin Chin Shue

(74) *Attorney, Agent, or Firm* — Workman Nydegger

(57) ABSTRACT

The present invention provides a universal belay device for providing safety to mountain and rock climbers. The belay device allows a belayer to selectively operate the device in any of a plurality of modes. In an auto-locking mode, a fall by a climber automatically stops the rope without requiring the belayer manually apply any holding or stopping force. In a frictional mode, a fall by a climber is stopped by the belayer applying a minimal amount of pressure. The belay device includes a housing in which a rope pin and cam are contained. The cam is rotable to a first position which allows the rope pin to frictionally secure the rope against the housing and stop the rope. The cam is rotable to a second position which substantially prevents the rope pin from fully securing the rope and requires the user to apply a stopping force to stop the rope.

18 Claims, 7 Drawing Sheets

U.S. PATENT DOCUMENTS

| | | | | |
|---|---|---|---|---|
| 4,678,059 | A | 7/1987 | Bowker | |
| 5,054,577 | A | 10/1991 | Petzl | |
| 5,360,083 | A | 11/1994 | Hede | |
| 5,638,919 | A | 6/1997 | Pejout | |
| 5,850,893 | A | 12/1998 | Hede | |
| 5,924,522 | A | 7/1999 | Ostrobrod | |
| 5,934,408 | A | 8/1999 | Flux | |
| 5,975,243 | A | 11/1999 | Lorbek | |
| 6,029,777 | A | 2/2000 | Rogelja | |
| 6,095,502 | A | 8/2000 | Dodge | |
| 6,378,650 | B2 | 4/2002 | Mauthner | |
| 6,607,058 | B2 * | 8/2003 | Angerbauer et al. | 188/65.1 |
| 6,681,891 | B2 | 1/2004 | Richard | |
| 6,732,833 | B2 | 5/2004 | Rogelja | |
| 6,843,346 | B2 | 1/2005 | LeBeau | |
| 6,899,203 | B1 | 5/2005 | Golden | |
| 7,055,651 | B2 | 6/2006 | Klingler | |
| 7,055,653 | B2 | 6/2006 | Hamada | |
| 7,080,716 | B2 | 7/2006 | Cherpitel | |
| 2008/0087498 | A1 | 4/2008 | Barzilai | |
| 2008/0164096 | A1 | 7/2008 | Rogelja | |

FOREIGN PATENT DOCUMENTS

| | | |
|---|---|---|
| FR | 2671489 | 1/1991 |

OTHER PUBLICATIONS

U.S. Appl. No. 11/381,991, mailed Dec. 11, 2008, Office Action.
U.S. Appl. No. 11/381,991, mailed Apr. 28, 2009, Office Action.
U.S. Appl. No. 11/381,991, mailed Jan. 22, 2010, Office Action.
U.S. Appl. No. 11/381,991, mailed Apr. 30, 2010, Notice of Allowance.

* cited by examiner

UNIVERSAL BELAY DEVICE

CROSS-REFERENCE TO RELATED APPLICATIONS

This application is a continuation-in-part of U.S. patent application Ser. No. 11/381,991, filed May 5, 2006, now U.S. Pat. No. 7,757,812 and entitled UNIVERSAL BELAY DEVICE, which claims the benefit of U.S. Provisional Patent Application No. 60/677,961, filed May 5, 2005, and entitled UNIVERSAL BELAY DEVICE, each of which is incorporated herein by reference in its entirety.

BACKGROUND OF THE INVENTION

1. The Field of the Invention

Exemplary embodiments of the invention relate to the field of mountain and rock climbing. More particularly, the invention relates to belay devices and systems for controlling the ascent or descent of a climber, and methods for using the same.

2. The Relevant Technology

Mountain and rock climbing is a challenging endeavor in which an individual can ascend or descend a rock face that is often close to vertical. At the start of such a climb, the individual chooses a path that will be taken to ascend or descend the face. Particularly for ascending a rock face, the individual must use his entire body, as well as various pieces of specialized equipment. For example, the individual may use specially designed ropes, harnesses, carabiners, shoes, and the like.

Frequently, the climber is not alone when climbing the rock. The safety of the climber can be enhanced by climbing in teams. When climbing as a team, the climber may tie the special climbing rope to a harness worn by the climber, while the other team member belays the climber. As a climber ascends the rock, for example, the belaying partner controls the tension in the rope. The belaying partner can control this tension either by letting out rope or taking rope up to maintain a proper tension in the rope. This tension is important if a climber falls as the greater the tautness or tension in the rope, the less of a distance the climber can fall.

Various belaying systems can be employed. For example, a top-roping belay system uses an anchor that is placed at the top of the rock. The climber's rope extends through the anchor, and the anchor acts as a pulley. The belaying partner may stand at the top of the cliff to belay the climber, although the partner typically stands at the foot of the rock. In either case, the anchor remains at the top of the rock and the rope extends downward toward the climber from above while the partner controls the tension to ensure that the climber will not fall any great distance if he loses his footing or grip on the mountain.

Another belaying system is a lead climbing system in which the climber drags the rope up the mountain and the rope is fed to the climber from below. During the ascent, the climber may clip the rope into carabiners which are secured to the rock at various points up the mountain.

Whether the rope is being fed to the climber in a top-rope or lead climbing system, when the climber falls, the belaying partner uses the belay device to grasp and secure the rope. In this manner, the fall of the climber is stopped and the climber is suspended above the ground. The belaying partner can then lower the climber to the ground by gradually allowing rope to extend through the belay device.

These and other types of belay devices are commonly frictional devices that allow large forces applied to a rope to be held by the belaying partner with little effort. In most cases, the large forces are reduced by belay devices based on the Capstan effect. In such a system, the rope is wrapped around a pin to dramatically reduce the required holding force.

Belay devices of this type generally do not allow a belaying partner to secure more than one rock climber. In addition, such devices generally require that the belaying partner exert some stopping force on the rope to prevent the fall. Sometimes, however, it would be beneficial to have a self-locking belay device such that the belayer need not exert any force. For example, this may allow a climber to climb without a partner. In other cases, however, a self-locking device may introduce larger impact forces that are not recommended for certain types of climbing (e.g., ice climbing or traditional climbing). Accordingly, what are desired are devices and systems that allow a belayer to belay multiple climbers at the same time and with a single device, and which is universal to allow selective use between self-locking and non-self locking modes of operation.

BRIEF SUMMARY OF THE INVENTION

Exemplary embodiments of the invention relate to a universal belay device for repelling and mountain or rock climbing. In some embodiments, the belay device includes a plurality of rope windows to allow the belayer to belay rope for multiple climbers. In some embodiments, for instance, the belay device can accommodate two ropes regardless of whether the two ropes are of different sizes, radial stiffness, or the like. In additional embodiments, a switch is included to allow the belayer to selectively control the mode of operation of the belay device. For example, the switch may switch between an auto-locking mode in which the belayer need not apply any stopping force to a rope and a frictional mode in which the belayer must apply a small force to stop the rope.

In one exemplary embodiment, the belay device includes a housing with a ramp. A sliding member may be received within the housing while at least one cam is rotably linked to the housing. The cam can be configured to facilitate the positioning of the sliding member relative to the ramp such that when the cam is in a first position, the sliding member is closer to the ramp than when the cam is positioned in a second position.

In some embodiments, a stop is slideably linked to the housing and positioned between the sliding member and the cam. Optionally, the stop is configured to engage the sliding member when the cam is in the second position.

In still other embodiments, the belaying device housing includes a body that has a groove. The groove may be configured to receive the sliding member therein and allow the sliding member to move along the length of the groove while preventing axial movement of the sliding member. In some embodiments, a longitudinal axis of the sliding member is substantially perpendicular to the length of the groove as the sliding member moves along the length of the groove. Such an embodiment is particularly useful when multiple, similar ropes are used in the belay device at the same time. In additional embodiments, the longitudinal axis of the sliding member can form an acute angle with the length of the groove as the sliding member moves along the length of the groove. This embodiment can be useful when multiple ropes of differing size, radial stiffness, or the like, are used in the belay device at the same time.

In some embodiments, the housing may also include a first wing that is rotably coupled to a first side of the body. An optional second wing may also be coupled to a second side of the body such that the first and second wings are configured to facilitate the retention of the rope(s) within the housing when the rope(s) is positioned within the housing and wrapped around the sliding member. The belaying device may further include a lowering level which is rotably lined to the first and second wings or other portion of the housing. The lower lever may further be linked to the stop such that rotation of the lowering level facilitates engagement of the sliding member by the stop to in turn increase the distance between the sliding member and the ramp. As noted, the housing can be configured to receive and retain more than one rope therein.

In some embodiments the first and second positions of the sliding member correspond to first and second operating modes of the belay device. In one embodiment, the belay device is configured in an auto-locking mode that locks the rope with almost no force being applied by a belayer. A second, frictional mode may also be selected in which a belayer must exert a small amount of force to stop the rope. Optionally, the belay device provides visual feedback to indicate the mode. For example, the one or more cams may be color-coded to signal the mode in which the belay device is operating.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION OF THE PREFERRED EMBODIMENTS

Exemplary embodiments of the present invention relate to a universal belay device that may be used for repelling or climbing. The universal belay device may be operated in either an auto-locking mode, thereby allowing a belayer or the climber to catch a fall without the need for the belayer or climber to apply a holding force on the climbing rope. The universal belay device may also be operated in a frictional mode which allows the belayer to apply a modest force to the rope in order to catch the climber in the event of a fall.

Reference will now be made to the drawings to describe various aspects of exemplary embodiments of the invention. It is understood that the drawings are diagrammatic and schematic representations of such exemplary embodiments, and are not limiting of the present invention, nor are they necessarily drawn to scale. No inference should therefore be drawn from the drawings as to the dimensions of any invention or element. In the following description, numerous specific details are set forth in order to provide a thorough understanding of the present invention. It will be obvious, however, to one of ordinary skill in the art that the present invention may be practiced without these specific details. In other instances, well-known aspects of climbing equipment and methods have not been described in particular detail in order to avoid unnecessarily obscuring the present invention.

Figure 1:
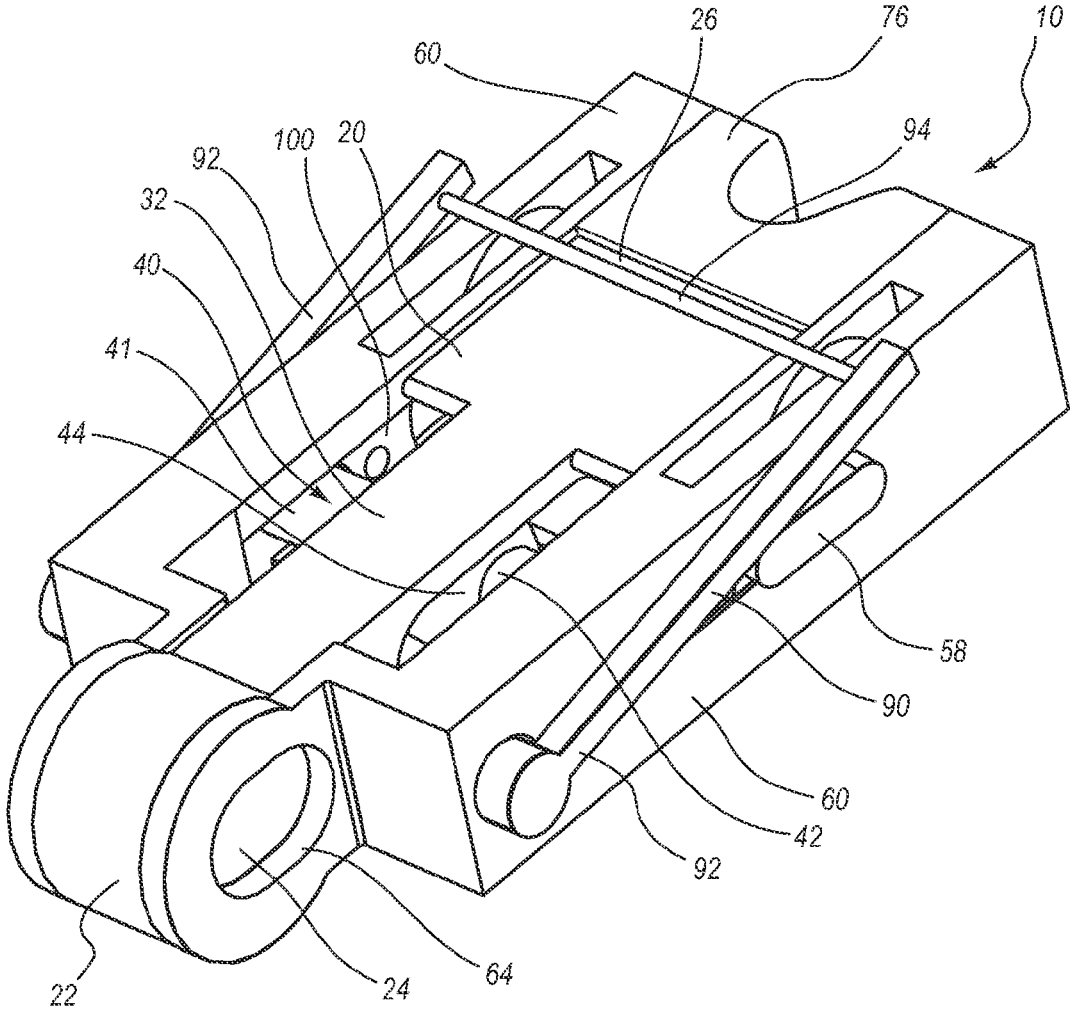
FIG. 1 is a top perspective view of a belay device according to one embodiment of the present invention, the belay device having a device body, first and second wings, a cam assembly, a lowering lever and a rope pin.
Figure 2:
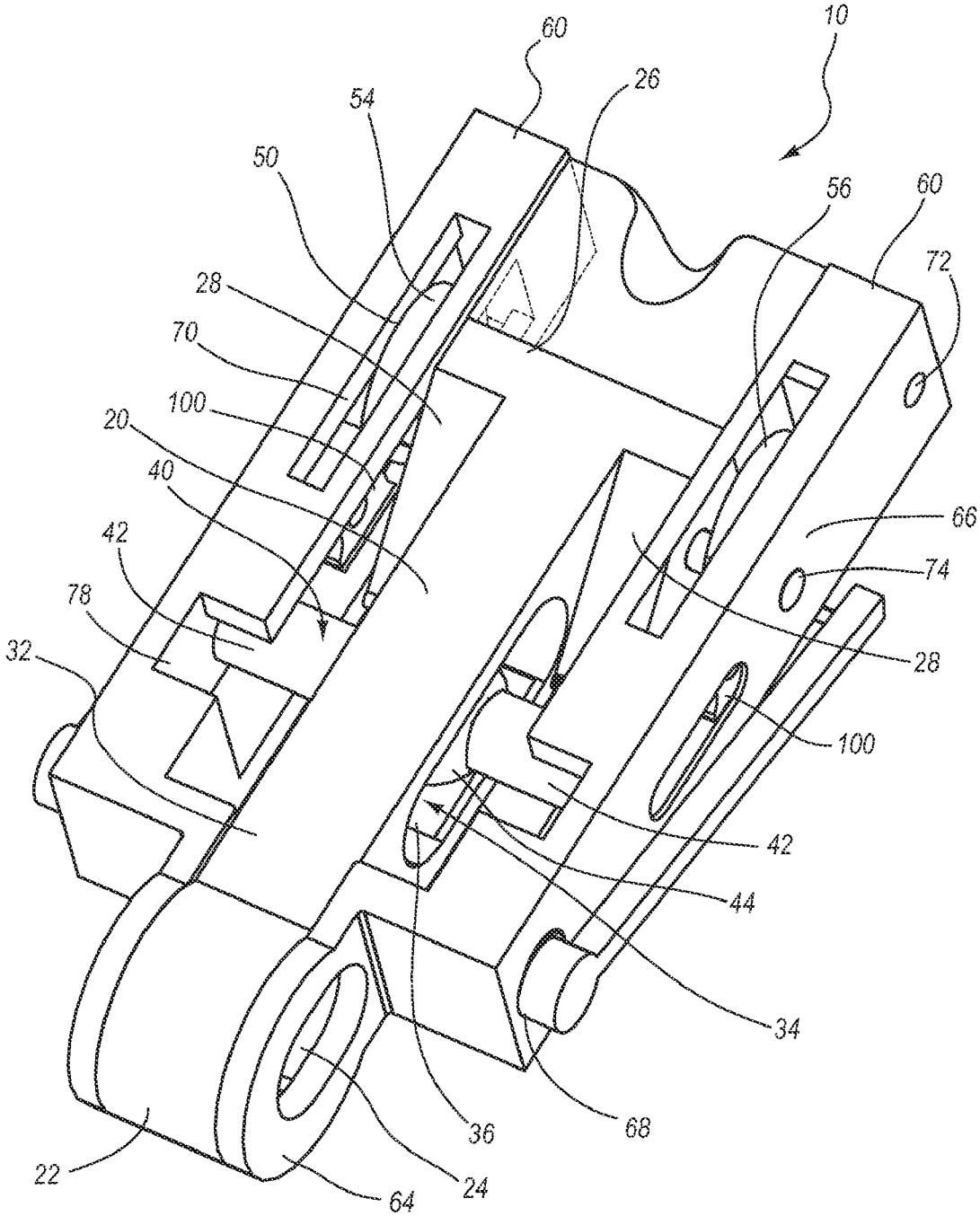
FIG. 2 is a perspective view of the belay device of FIG. 1, as viewed from the underside.

FIGS. 1 and 2 illustrate an exemplary belay device 10 according to one embodiment of the present invention. As described in greater detail hereafter, belay device 10 acts as a housing for one or more ropes used by one or more climbers who are ascending or descending with the use of a rope. Although belay device 10 will be described in relation to a climber ascending or descending a mountain or rock, it should be appreciated that a climber may use a rope to ascend or descend in any of a variety of manners. For example, belay device 10 may be used to assist a climber descending a rope extended from a hovering helicopter. Accordingly, it should be appreciated in light of the disclosure herein that belay device 10 can be used in any of a variety of applications.

In the exemplary embodiment illustrated in FIGS. 1 and 2, belay device 10 includes a body 20 and multiple wings 60 which are adjacent to and rotably coupled to body 20. The use of wings 60 in connection with body 20 is desirable for a variety of reasons. For example, as illustrated, belay device 10 further includes a rope pin 40 and a cam assembly 50 for controlling elements of belay device 10. Wings 60 are positioned on the sides of body 20 and can thereby house and contain these controlling elements to the extent they extend outside of body 20.

As illustrated, body 20 is, in this embodiment, substantially T-shaped, and has a first end 22 and an opposing second end 26. As illustrated, first end 22 includes, in one embodiment, a carabiner mount 24 for facilitating connection of belay device 10 to a harness of a belayer. Carabiner mount 24 may be configured in any of a variety of manners. In the illustrated embodiment, for example, carabiner mount 24 is substantially tubular, such that it is generally cylindrical in shape and has a channel extending through the width of first end 22. In this manner, a portion of a carabiner can be inserted through the channel and secured around the walls of tubular carabiner mount 24.

As best illustrated in FIG. 2, body 20 includes, in some embodiments, one or more ramps 28 at second end 26. As can be seen in the Figures, the illustrated embodiment of belay device 10 includes two ramps 28. The two ramps 28 are disposed on opposing sides of second end 26. In light of the disclosure herein, it will be appreciated that belay device 10 can be configured with one, two, or more ramps 28. Similarly, while belay device 10 is sometimes described herein with reference to a single ramp 28, it will also be appreciated that such description is equally applicable to a belay device 10 with multiple ramps 28.

As described in greater detail herein, in some operation modes of belay device 10, ramp 28 is configured to reduce the amount of force that need be applied by a belayer to stop a rope. For example, ramp 28 may act as a guide for the portion of the rope received by the belayer, and can increase the force applied by belay device 10 to stop the rope, thereby reducing the amount of force that the belayer need apply.

Between first end 22 and second end 26 of body 20 is an elongate intermediate portion 32. In the illustrated embodiment, body 20 is T-shaped such that carabiner mount 24 at first end 22 is more narrow than ramps 28 at second end 26. Accordingly, intermediate portion 32 connects the more narrow carabiner mount 24 to ramp 26.

Intermediate portion 32 is adapted to receive a rope pin 40 which allows one or more ropes to be secured by belay device 10. A rope is wrapped around pin 40, thereby giving rise to the Capstan effect. In this embodiment, intermediate portion 32 includes a pin slot 34 formed therein, in which pin 40 is inserted. Pin slot 34 may, in some embodiments be elongate. For example, as illustrated in FIGS. 1 and 2, pin slot 34 is elongate such that pin 40 may slide and travel along and within all or a substantial portion of pin slot 34. In particular, pin 40 is inserted into pin groove 34 such that it is axis is perpendicular or generally perpendicular to the elongate length of pin slot 34. Pin 40 has a diameter that is less than the elongate length of pin slot 34. Accordingly, pin 40 is contained, at least partially, within body 20, and can further remain contained therein while also traversing the length of pin slot 34, and thereby moving transaxially therein. As described in greater detail below, in some embodiments pin 40 can move within pin slot 34 so as to form an acute angle with body 20. This functionality can be particularly useful when belay device is used in connection with multiple ropes of different sizes, radial stiffness, and the like at the same time.

In some embodiments, pin 40 and/or slot 34 are further configured to prevent or resist axial movement of pin 40 when within slot 34. Stated another way, pin 40 and/or slot 34 may be adapted to reduce the risk that pin 40 will inadvertently become removed from within body 20. For example, in the illustrated embodiment, pin 40 includes a rod 42 and a spherical sleeve 44 which is mounted to rod 42 and centered along the length of pin 40. Within body 20, and along the upper and lower surfaces of the channel created by pin slot 34, a pin groove 36 may be formed therein which generally corresponds to the spherical shape of spherical sleeve 44. In this manner, pin 40 can be inserted within slot 34 of body 20, and spherical sleeve 44 can be positioned in pin groove 36. Spherical sleeve 44 can, accordingly, extend substantially the entire distance between upper and lower pin grooves 36, such that if pin 40 attempts to move axially, spherical sleeve 44 has little room in which to move and prevents such motion while still allowing pin 40 to move along the length of pin slot 34.

Spherical sleeve 44 can be a separate component from rod 42 such that rod 42 may be press fit therethrough. Such a combination is not, however limiting of the present invention inasmuch as this combination is not necessary. For example, in other embodiments it is contemplated that rod 42 be integrally formed with spherical sleeve 44. Accordingly, it will also be appreciated in light of the disclosure herein that spherical sleeve 44 can be formed of the same or different material as rod 44. For example, rod 42 may be a metal (e.g., steel, titanium, tungsten, etc.) while spherical sleeve 44 may be a polymer, composite or other type of metal. In other embodiments, however, rod 42 and spherical sleeve 44 are formed of the same metal, composite or polymeric material. In such case, it will be appreciated that pin 40 can be formed by casting, milling, or any other suitable type of molding process.

As further illustrated, belay device 10 may further include one or more cam assemblies 50 which are rotably linked to body 20 and/or wings 60. In the illustrated embodiment, for example, cam assembly 50 is rotably linked to body 22 at second end 26. In particular, cam assembly 50 includes a cam shaft 52 (see FIG. 4A) which extends through, and can rotate within, a cam channel 30 (see FIG. 4A) in second end 26 of body 20.

Cam assembly 50 further includes a first disk 54 and a second disk 56 connected to opposing ends of cam shaft 52. As discussed in greater detail herein, first and second disks 54, 56 are configured to facilitate the operation of belay device 10 in a plurality of operative modes. For example, when cam assembly 50 is in a first position, belay device 10 may be in a first, auto-locking mode. Optionally, cam assembly 50 can be rotated to a second position with respect to body 20. In such a second position, cam assembly 50 may provide a second operative mode such as a frictional mode in which a belayer must apply some holding force to stop the extension of a rope.

In addition, cam assembly 50 includes, in this embodiment, a mode switch 58 secured to first disk 54. Mode switch 58 is configured to allow a belayer to quickly and easily switch belay device 10 between operative modes. For example, in the illustrated belay device, a belayer may grasp or otherwise push upward on mode switch 58, which acts as a knob. Mode switch 58 is fixed with respect to first disk 54 and shaft 52, such that when switch 58 is turned, mode switch 58 rotates shaft 52 and thereby also rotates first and second disks 54, 56. In this manner, cam assembly 50 is moved and positioned in a second position. In some embodiments, mode switch 58 and cam assembly 50 can rotate approximately one-hundred eighty degrees between first and second positions corresponding to the first and second operative modes.

With continued reference to FIGS. 1 and 2, it will be seen that wings 60 act with body 20 to form a housing for pin 40 and cam assembly 50. In particular, in the illustrated embodiment, wings 60 have a body portion 66 in which at least a portion of pin 40 and cam assembly 50 are located. Wings 60 may have, for example, an internal cavity 78 in which the ends of rod 42 of pin 40 are contained. In this manner, internal cavity 78 further restricts pin 40 from moving in an axial direction. In addition, and as illustrated, internal cavity 78 may extend along a substantial length of body portion 66 such that first disk 54 and second disk 56 of cam assembly 50 are also contained within interior cavity 78. Although an interconnected internal cavity 78 is illustrated, it will be appreciated that such a cavity is exemplary only and that in other embodiments, internal cavity may be split into one or more cavities, slots, or grooves.

In some embodiments, such as where cam assembly 50 includes a mode switch 58, wings 60 may further include a cam hole 74 through which mode switch 58 extends. Optionally, cam shaft 52 of cam assembly 50 extends not only between first disk 54 and second disk 56, but also out from each of first and second disks 54, 56. In such an embodiment, the extended portion of can shaft 52 can also be received within cam hole 74 in body portion 66 of wings 60.

An extension on cam assembly 50 may be desirable for a variety of reasons. For example, as noted above, wings 60 may be rotably coupled to body 20. In one embodiment, wings 60 are rotably linked to body 20 through cam assembly 50. For example, wings 60 may be lifted with respect to body 20 and rotated around cam shaft 52. Accordingly, cam assembly 50 and body 20 may remain in their relative positions with respect to each other while only wings 60 are rotated.

As described in greater detail hereafter, one feature enabled by rotating wings 60 is the quick and easy insertion of a rope into belay device 10. In particular, as wings 60 are rotated, the rope can easily be inserted over and wrapped around rope pin 40. The belayer may then extend the rope to the climber and rotate wings 60 back down onto body 20 and cam assembly 50.

Wings 60 are, in this embodiment, further configured to prevent the inadvertent rotation of wings 60 with respect to body 20. Such a feature is desirable to avoid the accidental loosening of the rope within wings 60 as the belayer is belaying a climber. In this embodiment, a carabiner attachment 64 is formed at a first end of wings 60. Carabiner attachment 64 corresponds to carabiner mount 24 of body 20. For example, carabiner attachment 64 is substantially tubular and cylindrical such that it is approximately the same shape and size as carabiner mount 24. Further, carabiner attachment 64 includes a channel therethrough corresponding to the channel in carabiner mount 24. In this manner, when the belayer desires to attach a carabiner to belay device 10, the carabiner can be inserted around carabiner attachments 64 on each of wings 60, as well as around carabiner mount 24 on body 20. With the carabiner secured in place, carabiner attachments 64 are secured in place, thereby preventing the rotation of wings 60 with respect to body 20.

Optionally, one or more of wings 60 may be connected to a rope guide 76. In the illustrated embodiment, for example, rope guide 76 is secured to body portion 66 of each wing 60. Rope guide 76 acts to enclose second end 26 of body 20. In this manner, as a rope is extended into belay device 10, it may extend over rope guide 76 and not interfere with body 20 (see FIG. 3). Rope guide 76 may be configured in any of a variety of manners. In the illustrated embodiment, for example, rope guide 76 includes a U-shaped channel through which one or more ropes may be received. It should be appreciated, however, that this feature is not necessarily limiting of the present invention and that other shapes are contemplated. For example, in some embodiments, rope guide 76 may have one or more hooks extending therefrom to control the positioning of the rope.

Rope guide 76 may be secured or mounted to wings 60 in any suitable manner. For example, in some embodiments wings 60 are formed of a metal such as steel or titanium, while rope guide 76 is a composite material or a polymer such as synthetic rubber, latex, or the like. In such case, rope guide 76 may be affixed to wings 60 with an adhesive. Alternatively, one or more dovetail grooves may be formed in wings 60 and one or more corresponding dovetail posts formed in rope guide 76 to mate with the dovetail grooves. In other embodiments, however, rope guide 76 may also be made of a metal material and may, in some cases, be integrally formed with wings 60 such that one or more of wings 60 and rope guide 76 are produced as a single unit. Alternatively, such as in the illustrated embodiment, wings 60 may include one or more rope guide cavities 72. Rope guide 76 may, accordingly, have a corresponding post or rod which is inserted into cavities 72 to thereby secure rope guide 76 in place.

In light of the above description, it should be appreciated that rope guide 76 accordingly can act as a bridge. In particular, rope guide 76 can not only secure and guide the loose end of rope 110, but it further keeps wings 60 moving together as a single, cohesive unit.

As further illustrated in FIGS. 1 and 2, universal belay device 10 can, in some embodiments, include a lowering lever 90. In the illustrated embodiment, lowering lever 90 may be a metal, polymeric, or composite device that is substantially C-shaped and connects wings 60. For example, as illustrated, lowering lever 90 may include end posts 92 which are secured to body portion 66 of wings 60. End posts 92 angle slightly above and away from the first end of wings 60, where end posts 92 are connected to a support handle 94.

Lowering lever 90 can, in this manner facilitate the rotation of wings 60 and the insertion of one or more ropes within belay device 10. In particular, a belayer may grasp hold of support handle 94 and pull upward. Where wings 60 are pivotally or rotably linked to body 20, wings 60 may thereby be rotated and provide an opening through which a user may insert one or more ropes. Moreover, inasmuch as lowering lever 90 can be connected to both wings 60, lowering lever 90 allows wings 60 to be moved together as a cohesive unit.

Another feature of lowering lever 90 is that it provides a convenient handle that may be used by a belayer when using belay device 10. In particular, as the belayer is extending rope to a climber, the belayer will obtain a solid footing and extend the rope through belay device 10. Accordingly, to guard against being pulled off balance by the climber, the belayer may grasp hold of handle 94, thereby enabling the belayer to have greater control over belay device 10 and the rope extending therethrough. In other embodiments, lowering lever 90 can further act as a lowering lever, as discussed in more detail with respect to FIG. 8.

Also illustrated in FIGS. 1 and 2 are stops 100 which are positioned within internal cavity 78 of each of wings 60. Stops 100 are configured to slide inside wings 60 and extend between cam disks 54, 56 and pin rod 42. As will be described in greater detail hereafter, stops 100 act in connection with cam assembly 50 and pin 40 to determine the operative mode of belay device 10.

Figure 3:
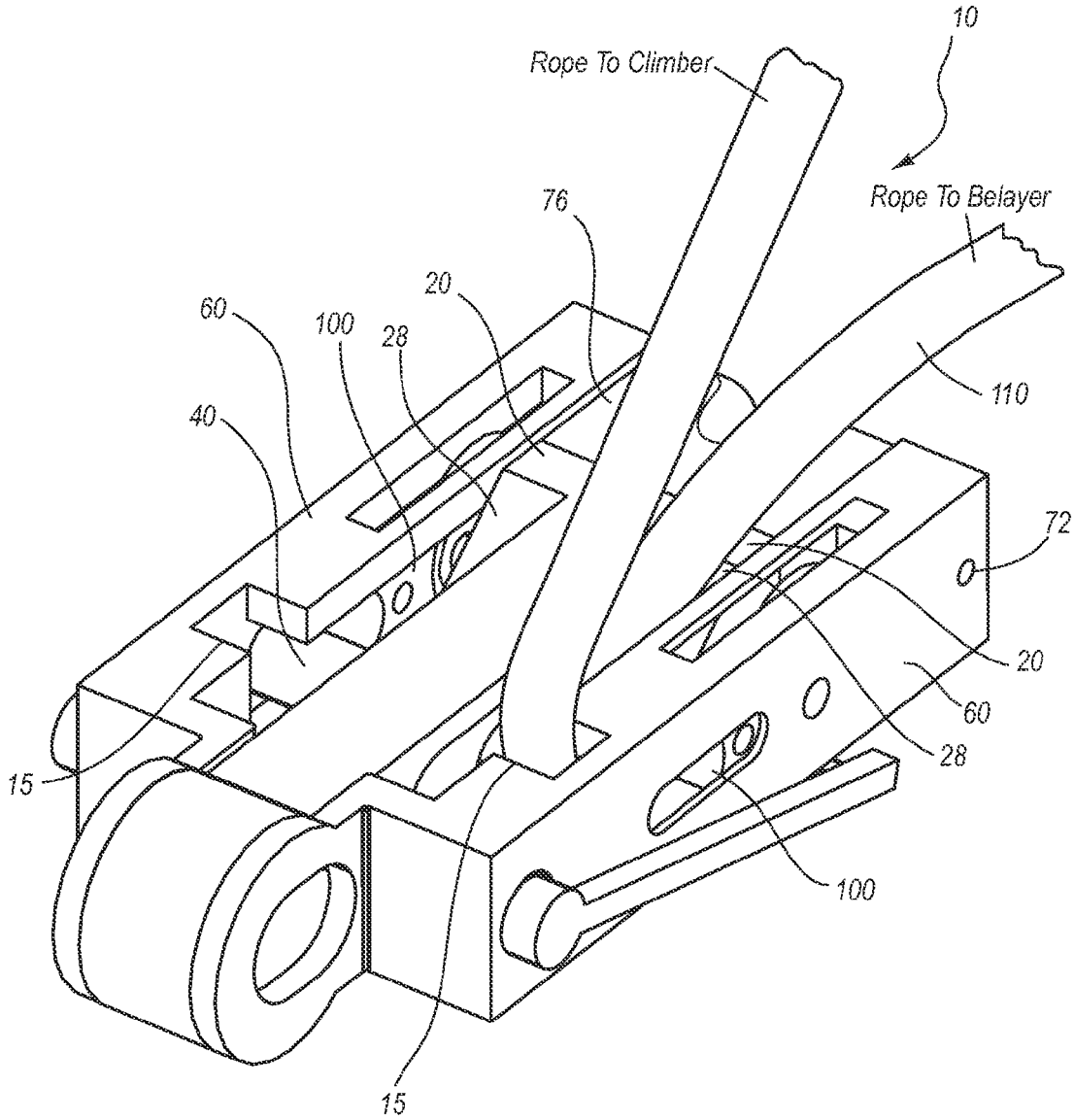
FIG. 3 is a perspective view of the belay device of FIGS. 1 and 2, the belay device having a rope inserted therein.

Turning now to FIG. 3, the use of an exemplary universal belay device 10 is illustrated in connection with a single rope 110. In particular, a an exemplary universal belay device 10 is illustrated in which rope 110 is extended through belay device 10 to allow a climber to use rope 110 to ascend or descend a rock, while the belayer maintains control over rope 110. As illustrated, a loose end of rope 110 enters belay device 110 along rope guide 76. This is the case whether the belayer is positioned above or below the climber. The loose end of rope 110 extends along rope guide 76 and into contact with body 20. As illustrated, rope 110 contacts ramp 28 at second end 26 of body 20. From there, rope 110 is wrapped around rod 42 of rope pin 40 where the rope is then extended up to the climber.

To position rope 110 in this manner, wings 60 may be lifted and rotated about cam shaft 52 as previously described, or may be rotated or removed from body 20 in any other suitable manner. Upon removal or lifting of one or both of wings 60, the belayer may more easily access rope pin 40 so as to wrap rope 110 therearound. Once the rope has been wrapped around pin 40, the belayer may then close belay device by rotating wings 60 back onto body 20.

Figure 6:
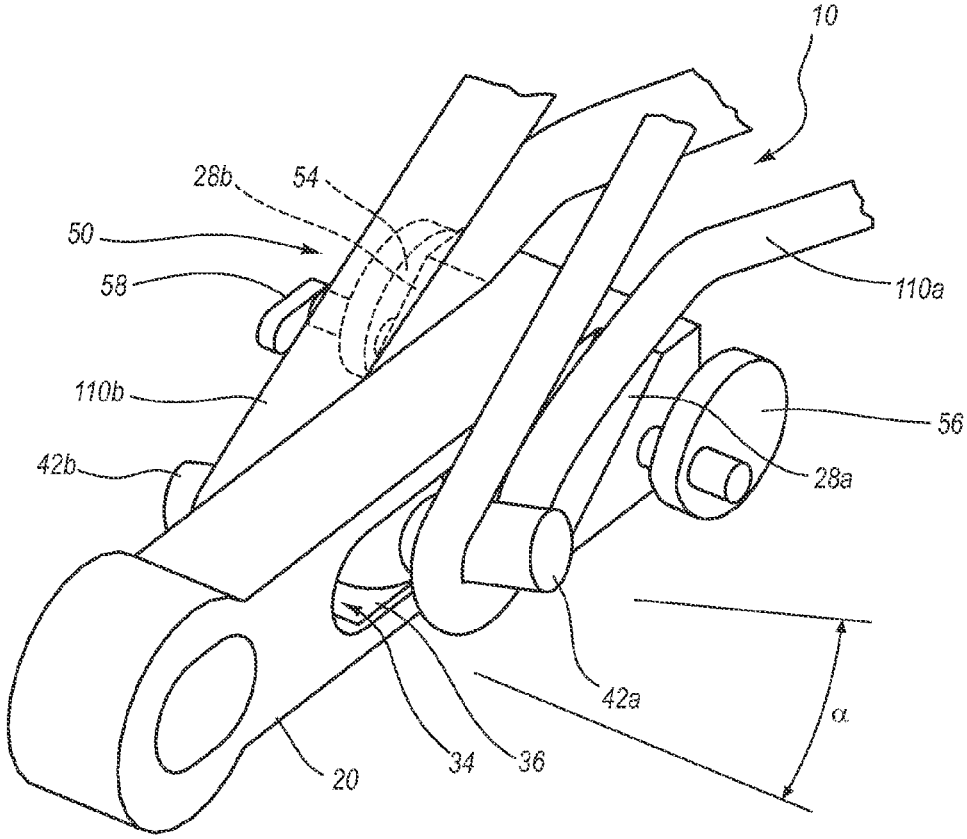
FIG. 6 is a perspective view of an exemplary belay device used in connection with two ropes of different sizes, wherein the belay device has the wings removed.
Figure 7:
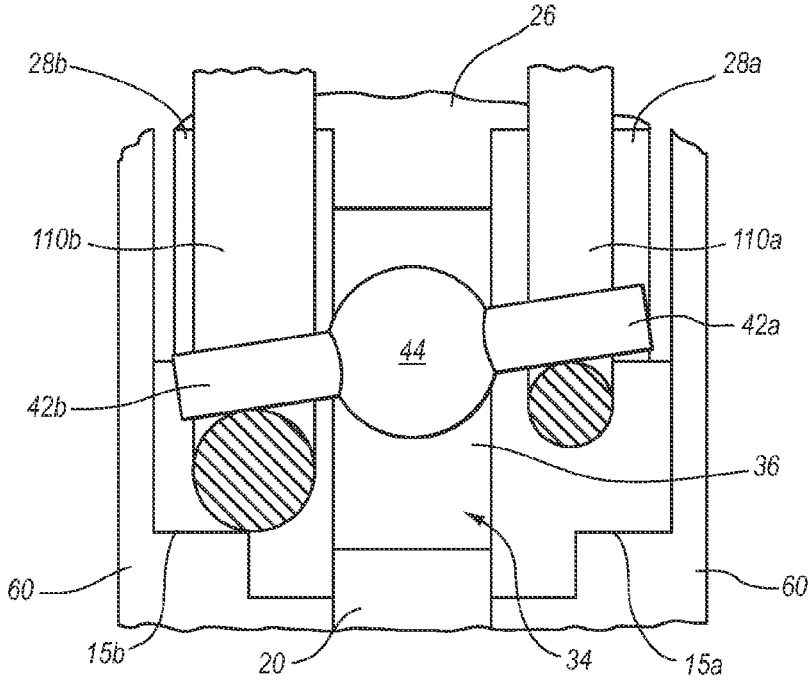
FIG. 7 is a partial cross-sectional view of the belay device of FIG. 6 with the two different sized ropes, illustrating the functionality of the rope pin in connection with the different sized ropes.

In the illustrated embodiment, a single rope 110 is illustrated as being positioned in belay device 10 and extended to a climber. It should be appreciated in light of the disclosure herein, specifically in connection with the discussion of FIGS. 6 and 7 below, that this is exemplary only and only one rope is illustrated for clarity. In particular, rope 110 is illustrated on the right side of body 20, while no rope is on left side of body 20. The use of body 20 with left and right wings 60, however, creates two rope openings 15 into which a rope can be inserted and belayed. Accordingly, it should be appreciated that while rope 110 is illustrated in rope opening 15 on the right side of body 20, it could just as easily be positioned in rope opening 15 on the left side of body 20. Alternatively, as illustrated in FIGS. 6 and 7 and discussed in connection therewith, a second rope could be used and extended through both left and right rope openings 15 such that the belayer can belay two ropes at once such as where, for example, there are two climbers. Moreover, the climbers can simultaneously move at different speeds. Accordingly, it will be appreciated in light of the disclosure herein that rope can be loaded into either or both sides of body 20, and that ropes of various sizes, including all commercially available rope diameters, may be effectively used in connection with universal belay device 10, either alone or at the same time.

Figure 4A:
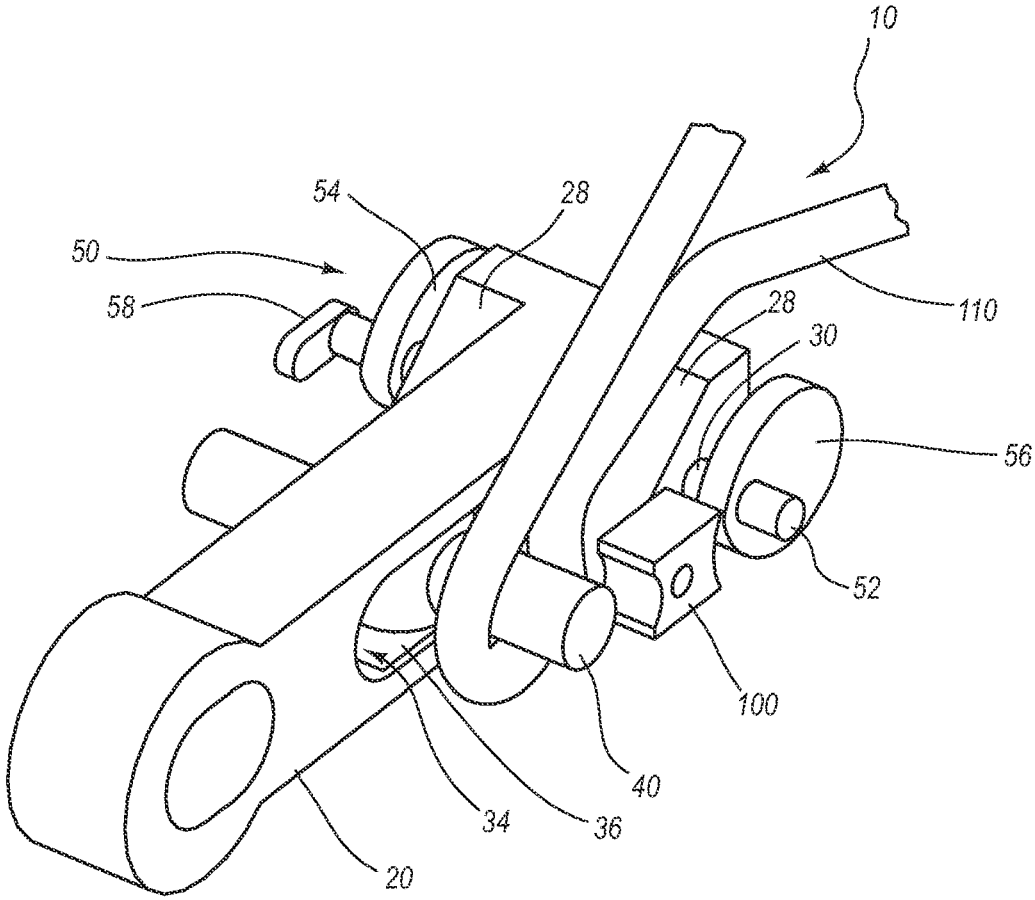
FIG. 4A is a perspective view of an exemplary belay device used in connection with a rope, wherein the belay device has the wings removed and is in an auto-locking mode.

FIGS. 4A-5B further illustrate the use of a rope 110 in connection with a universal belay device 10 according to the present invention, and in which a belayer may choose between multiple operative modes. In FIGS. 4A and 4B, for example, a cutaway view of belay device 10 is illustrated in which wings 60 and optional lowering lever 90 have been removed to provide a more clear view of the controlling elements of belay device 10.

Figure 4B:
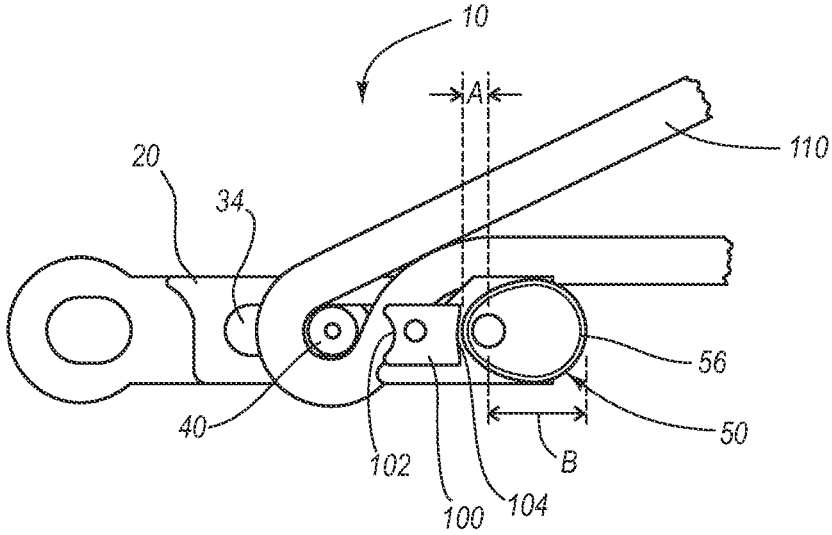
FIG. 4B is a side view of the belay device of FIG. 4A in the auto-locking mode.
Figure 5A:
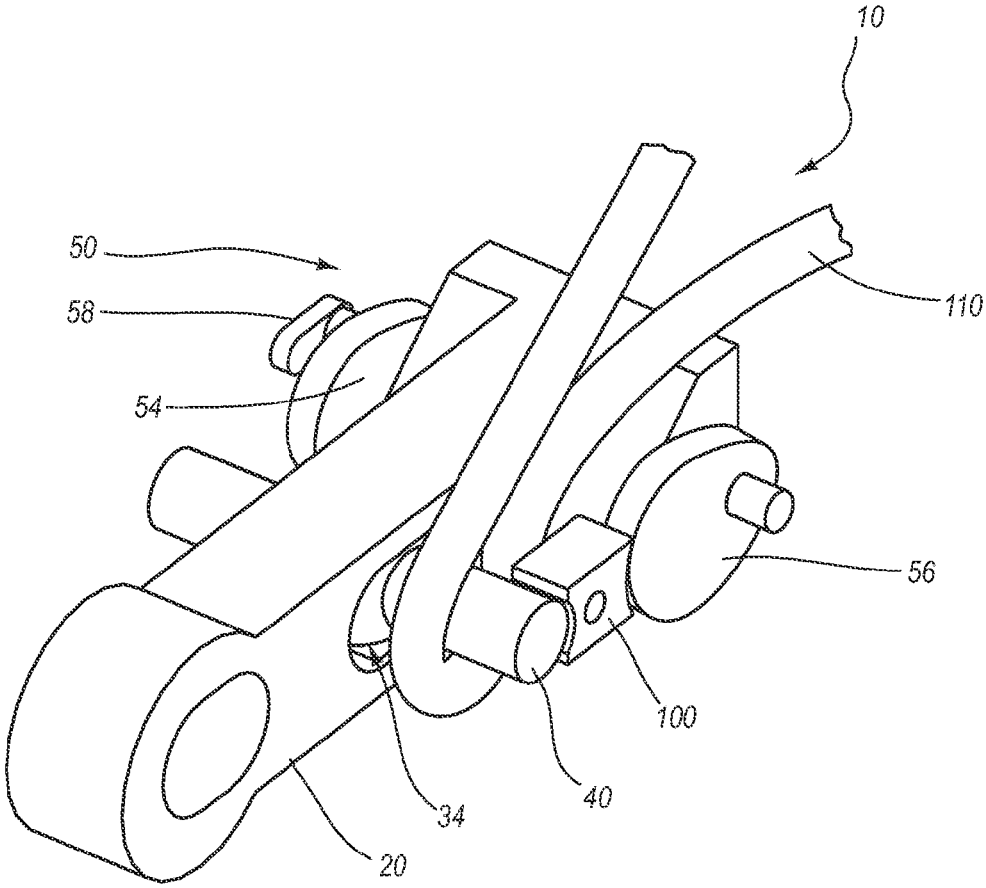
FIG. 5A is a perspective view of an exemplary belay device used in connection with a rope, wherein the belay device has the wings removed and is in a frictional mode.
Figure 5B:
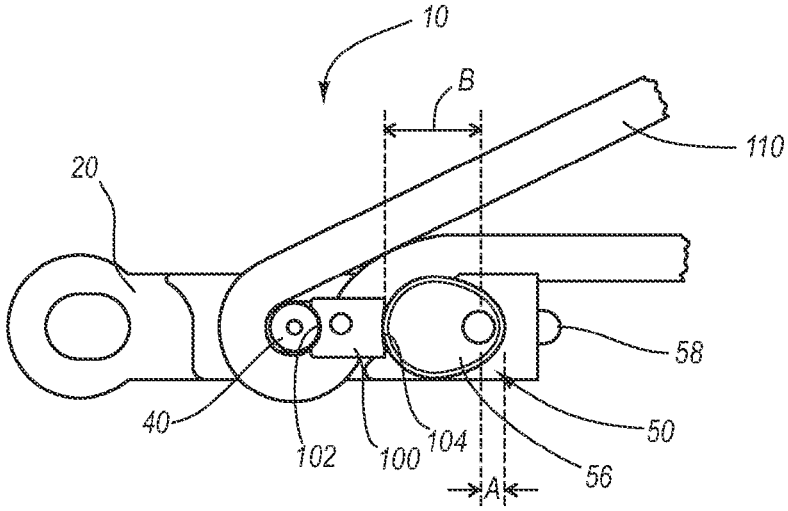
FIG. 5B is a side view of the belay device of FIG. 5A in the frictional mode.

In the embodiment illustrated in FIGS. 4A and 4B, an exemplary belay device 10 is illustrated in an auto-locking mode. As illustrated, belay device 10 includes a body 20 having a pin slot 34 through which pin 40 is inserted. Belay device 10 also includes a cam assembly 50 which includes a cam shaft 52 which extends through a cam channel 30 in body 20. As illustrated, cam assembly 50 includes first and second cam disks 54, 56 on each side of body 20.

Cam assembly 50 further cooperates with stops 100 (only one stop 100 shown) which are positioned between disks 54, 56 and opposing ends of pin 40. In the illustrated embodiment, stops 100 are configured to facilitate the positioning of pin 40, thereby also controlling the operative mode of belay device 10. For example, in the illustrated embodiment, stops 100 move and slide freely within internal cavity 78 or another groove inside wings 60. In the illustrated embodiment, stops 100 may also be attached to slider guides that slide in a groove on the outside of the wings 60. In this manner, stops 100 can freely move to various positions to facilitate the selection of multiple operative modes of belay device 10.

Stops 100 may include first curved portion 102 and second curved portion 104. First curved portion 102 is configured to cooperate with pin 40. For example, in the illustrated embodiment, first curved portion 102 has a curve radius approximately equal to the curve radius of pin 40 and can mate therewith.

Second curved portion 104 is further configured to cooperate with cam disks 54, 56. In this embodiment, disks 54, 56 are egg-shaped and cam shaft 52 is offset from the center of cam disks 54, 56. In particular, cam shaft 52 is positioned nearer the end of disks 54, 56 that has a lower curve radius and further from the end having a greater curve radius.

By using such a cam assembly 50, the belayer can select that belay device 10 be operated in an auto-locking mode such as that illustrated in FIGS. 4A and 4B. A feature of the auto-locking mode is that if the climber begins to fall, the tension on the rope will cause the belay device to lock without the need for a belayer to exert any stopping or holding force on the rope. This can be useful where, for example, a climber is ascending or descending without the assistance of a belaying partner. The climber may, accordingly secure belay device 10 to the ground and if he falls or becomes incapacitated, the auto-locking feature will cause rope 110 to lock in place and prevent the climber from falling.

To create the auto-locking effect, mode switch 58 of cam assembly 50 is rotated forward, and such that the smaller-radius portion of disks 54, 56 is positioned toward pin 40. As noted, cam shaft 52 is also positioned closer the smaller-radius portion. Accordingly, the distance A represents the linear distance between the center of cam shaft 52 and the front end of disks 54, 56 (i.e., the small radius end), while distance B represents the linear distance between the center of cam shaft 52 and the back end of disks 54, 56 (i.e., the larger radius end). As illustrated, in this case, distance A is less than distance B.

As noted previously, in the illustrated embodiment, when the smaller radius end of disks 54, 56 is closer to pin 40, belay device 10 is in the auto-locking position. As will be appreciated in light of the disclosure herein, when such positioning is used, and during normal operation of belay device 10, stops 100 are disengaged from rope pin 40, and rope pin 40 may freely slide along pin slot 34. However, as the tension or force on rope 110 increases as it is being belayed through belay device 10 to the climber, rope 110 will exert a greater force against pin 40, thereby pulling pin 40 closer toward stop 100 and ramp 28 on second end 26 of body 20. As illustrated, when rope 110 is forced toward second end 26 of body 20, it contacts ramp 28. Because pin 40 is also pulled closer to ramp 28, pin 40 and ramp 28 collectively pinch rope 110 in place, creating additional friction on rope 110. In particular, the Capstan effect is increased such that the rope is locked in place without the need of the belayer to apply any additional holding or stopping force.

To remove belay device 10 from the auto-locking mode, the belayer may grasp hold of mode switch 58 on cam assembly 50 and rotate it. Now referring to FIGS. 5A and 5B, for example, mode switch 58 has been rotated approximately one hundred eighty degrees, thereby also rotating cam disks 54, 56 by the same amount. As illustrated, when mode switch 58 is rotated in this manner, the larger radius end of disks 54, 56 is directed towards rope pin 40. Accordingly, distance B of disks 54, 56 is positioned toward stops 100 and pin 40. Where distance B is greater than distance A, this may cause disks 54, 56 to engage stops 100 and laterally move stops 100 closer toward pin 40. In some embodiments, such as that illustrated, second curved portion 104 of stops 100 may have a curve radius approximately equal to the curve radius of the larger radius end of disks 54, 56 to allow stops 100 to easily cooperate and mate with disks 54, 56 when so positioned.

In the illustrated embodiment, when cam assembly 50 is rotated such that disks 54, 56 engage stops 100, this may also force sliding stops 100 to engage rope pin 40, or engage rope pin 40 closer to the first end 22 of body 20. In such a case, as the tension on rope 110 increases, stops 100 restrict the motion of rope pin 40, thereby preventing rope pin 40 from approaching ramp 28. When such occurs, a greater distance exists between ramp 28 and pin 40 such that rope 110 is not pinched with as much force as when belay device 10 is in the auto-locking mode. Consequently, when a climber begins to fall, there is less friction on rope 100 along ramp 28, such that the belayer must exert a stopping force or holding force to restrain the fall of the climber. Accordingly, with cam assembly 50 in this second position, belay device 10 operates in a frictional mode and requires the belayer to exert at least a minimal stopping force to stop the rope.

In light of the disclosure herein, it should be appreciated that inasmuch as rope 110 is wrapped around pin 40, the Capstan effect can allow the belayer to exert only a small or modest holding force to stop the climber's fall. The amount of force required will, however, vary depending on various factors such as the type and size of rope used, the weight of the climber, and the like. For example, in many cases between fifteen and thirty pounds of force need be applied to stop the rope.

Accordingly, it should be appreciated in light of the disclosure herein that belay device 10 can be quickly and easily switched between operative modes without the need to either remove the ropes from the device or disconnect belay device 10 from a harness. In addition, as described herein, there are various advantages to each operative mode of belay device 10. For example, the auto-locking mode allows a belayer or climber to control the speed at which the rope is fed to the climber in case of a fall by effectively limiting any rope feed, while also not requiring a belayer to exert any holding force. This can be advantageous where, for example, the climber is climbing alone. In such a case, a universal belay device can be secured to the ground or rock or the climber may even carry the belay device.

When the auto-locking feature is triggers and the rope stopped, however, this may introduce a large impact force into the system, which can detrimentally affect climbing or safety equipment, bolds, or other protective features. This may be particularly undesirable for ice or traditional climbing. For example, such a force may pull the clips out of the rock wall thereby allowing the climber to fall a greater distance.

Accordingly, in some embodiments the belayer and/or climber may prefer that the belay device be operated in a frictional mode. In such a case, the belayer can exert a minimal stopping force to dynamically catch the fall of the climber, but can reduce the sudden impact force which could otherwise damage equipment and reduce safety.

It should also be appreciated that it is not necessary that cam disks 54, 56 have any particular shape or configuration. For example, while disks 54, 56 are illustrated as egg-shaped, this feature is exemplary only. By way of example, cam disks may be used in any of a variety of other irregular or regular shapes. In some embodiments, for example, the cam disks are regular shaped (e.g., circles) while the cam shaft is merely offset from the center of the disk.

Attention is now directed to FIGS. 6 and 7, which illustrate an exemplary embodiment of belay device 10. As noted above, one of the advantageous features of exemplary embodiments of the present invention is that multiple ropes can be used with the device and at the same time. For instance, belay device 10 in FIGS. 6 and 7 is illustrated as being used in connection with two ropes 110*a* and 110*b* at the same time. While belay device 10 is able to be used with a single rope or multiple, similarly sized ropes, belay device 10 is also able to be used with multiple ropes having different characteristics. For instances, belay device 10 can be used with multiple ropes having different diameters, radial stiffnesses, frictional coefficients, and the like.

By way of example, FIGS. 6 and 7 illustrate belay device 10 being used in connection with two ropes 110*a* and 110*b*, which have different diameters. Specifically, rope 110*a* has a first diameter and rope 110*b* has a second diameter that is larger than the diameter of rope 110*a*. Ropes 110*a*, 110*b* are received in belay device 10 as described above. Specifically, a loose end of rope 110*a* enters belay device 110 and contacts ramp 28*a* on the right side of second end 26 of body 20. From there, rope 110*a* is wrapped around rod 42*a* of rope pin 40, where the rope is then extended out of belay device 10 through rope opening 15*a*, and to the climber. Similarly, a loose end of rope 110*b* enters belay device 110 and contacts ramp 28*b* on the left side of second end 26 of body 20. From there, rope 110*b* is wrapped around rod 42*b* of rope pin 40, where the rope is then extended out of belay device 10 through rope opening 15*b*, and to the same, or a different, climber.

As discussed above, wings 60 may be lifted and rotated or removed from body 20 in any other suitable manner in order to facilitate the insertion of ropes 110*a*, 110*b*. Upon removal or lifting of one or both of wings 60, the belayer may more easily access rope pin 40 so as to wrap ropes 110*a*, 110*b* therearound. Once the ropes have been wrapped around pin 40, the belayer may then close belay device 10 by rotating wings 60 back onto body 20. Accordingly, it will be appreciated in light of the disclosure herein that a rope can be loaded into either or both sides of body 20.

In the illustrated case where ropes 110*a*, 110*b* are of different sizes, the configuration of rope pin 40 and body 20 make it possible to substantially independently control how much of each rope 110*a*, 110*b* is fed through belay device 10. More particularly, the relationship between spherical sleeve 44 of rope pin 40 and pin slot 34/pin groove 36 enables rope pin 40 to be positioned at various angles $\alpha$. For example, the longitudinal axis of rope pin 40 can be substantially perpendicular to the longitudinal axis of body 20. Alternatively, the longitudinal axis of rope pin 40 can form an angle $\alpha$ relative to the substantially perpendicular position so that different sized ropes can be simultaneously positioned between rods 42*a*, 42*b* and ramps 28*a*, 28*b*, respectively.

For instance, as illustrate in FIGS. 6 and 7, the spherical shape of spherical sleeve 44 enables rope pin 40 to rotate or pivot within pin slot 34/pin groove 36 so that rod 42*a* can be positioned closer to ramp 28*a* in order to pinch rope 110*a* therebetween. At the same time, the rotation of spherical sleeve 44 positions rod 42*b* further away from ramp 28*b* (in comparison to rod 42*a*'s position relative to ramp 28*a*) so as to accommodate the larger diameter rope 110*b*. In some embodiments, this configuration can allow for one rope to be pinched and held in place, while another rope is still free to move through belay device 10. In other embodiments, this configuration allows for both ropes to be pinched and held in place despite different physical characteristics in the ropes, such as diameter, radial stiffness, frictional coefficient, and the like.

As ropes 110*a*, 110*b* are fed through belay device 10, rope pin 40 is free to rotate or pivot within pin slot 34/pin groove 36 so as to substantially independently control the feed rate of each rope. For instance, if a climber using rope 110*a* falls, rod 42*a* will be pulled closer to ramp 28*a*, thereby pinching rope 110*a* between rod 42*a* and ramp 28*a* to prevent the climber from falling a great distance. At the same time, however, rope pin 40 can rotate or pivot within pin slot 34/pin groove 36 so as to accommodate the larger diameter rope 110*b*. For instance, rod 42*b* can be angled sufficiently to allow rope 110*b* to continue to be fed through belay device 10. Alternatively, rod 42*b* may be angled only enough to allow rope 110*b* to be positioned between rod 42*b* and ramp 28*b*. In other words, while still angled, rod 42*b* may be pulled close enough to ramp 28*b* so that rope 110*b* is pinched therebetween to prevent further feeding of rope 110*b* through belay device 10.

While FIGS. 6 and 7 and the related description have been directed to using belay device 10 in connection with ropes of different sizes, it will be understood that the functionality of rope pin 40 is equally applicable when the ropes have different radial stiffnesses, frictional coefficients, and the like. For instance, rope pin 40 can rotate or pivot so that rod 42*a* is closer to ramp 28*a* to pinch a softer rope while allowing rod 42*b* to be angled away from ramp 28*b*, thereby accommodating a stiffer rope. Additionally, while the illustrated and described embodiment is directed to a situation where rod 42*a* is positioned closer to ramp 28*a* than rod 42*b* is to ramp 28*b*, it will be understood that rod 42*b* can be positioned closer to ramp 28*b* than rod 42*a* is to ramp 28*a*.

Figure 8:
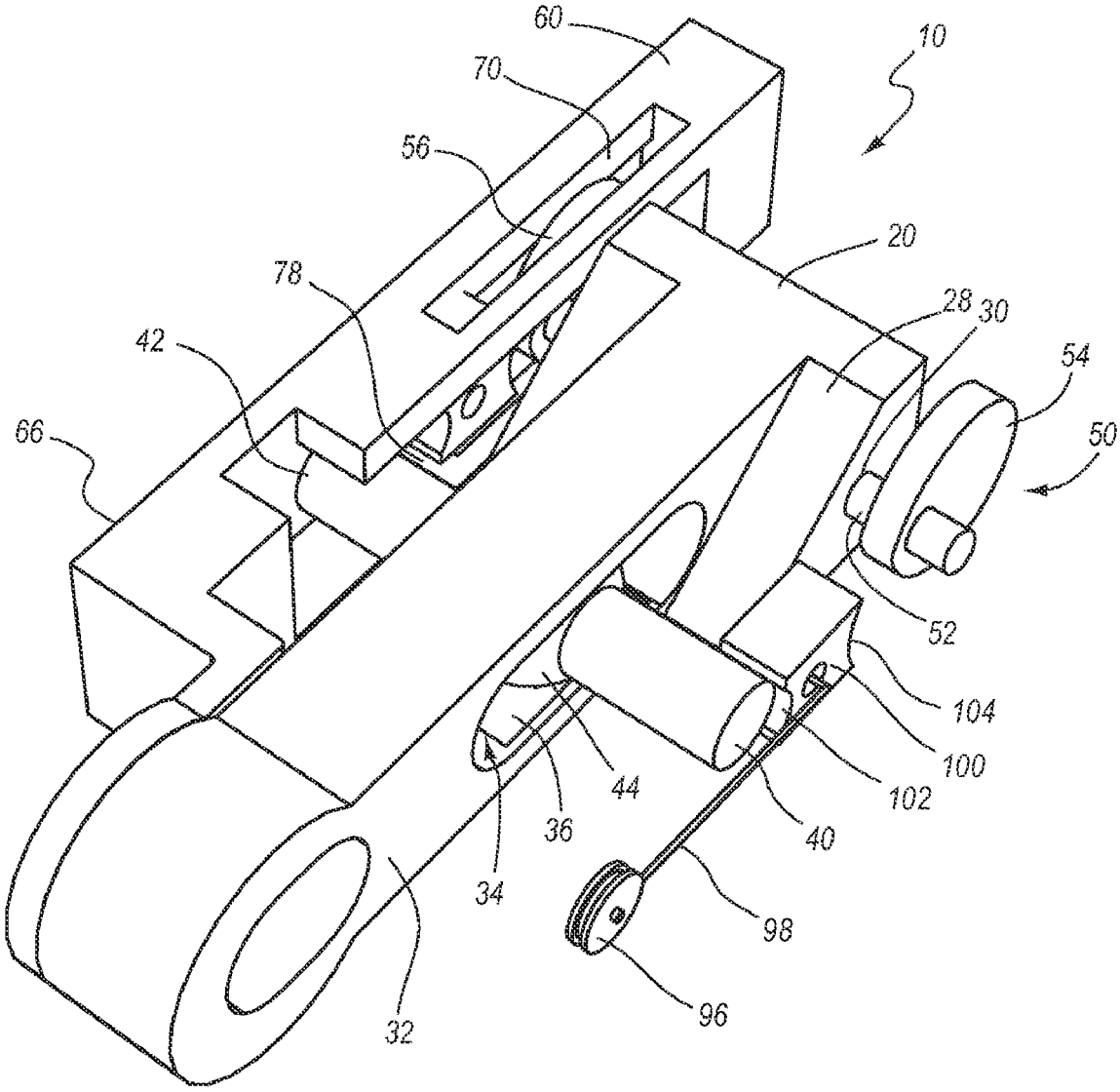
FIG. 8 is a cutaway view of an exemplary belay device illustrating the operation of the belay device.

Referring now FIG. 8, additional features of a universal belay device 10 will be described. FIG. 8 illustrates a cutaway view of an exemplary belay device 10 in which various components have been removed to provide a clearer view of optional internal features of the device. For example, in the illustrated embodiment, one wing 60 and one stop 100 have been removed, as has lowering lever 90.

In the illustrated embodiment, body 20 is illustrated in connection with a wing 60, rope pin 40 and cam assembly 50. In the illustrated embodiment, the ends of rod 42 of rope pin 40 have been inserted into internal cavity 78 of wing 60. Second disk 56 of cam assembly 50 has likewise been inserted therein, and is visible to a belayer through cam slots 70 on both the upper and lower faces of wing 60.

In some embodiments, cam assembly 50 is configured to allow the belayer to quickly and easily determine the mode in which belay device 10 is being operated. For example, the outside face of wing 60 may include indicia adjacent mode switch 58 to indicate whether mode switch is placed in an auto-lock or frictional mode. Alternatively, cam assembly may be color coded. For instance, cam disks 54, 56 may be color coded. One color (e.g., green) may, for example, be placed on half of the outside surface of cam disks 54, 56, such that when belay device 10 is in the auto-lock mode, the belayer will see green through slots 70. The other half of the outer surface of cam disks 54, 56 may be colored with a different color (e.g., red), thereby signaling to the belayer that the device is operating in the frictional mode.

In some embodiments, the ends of a lowering lever 90 (see FIGS. 1, 2) are rotably connected to wings 60. For example, end posts 92 of lower lever 90 may be have rods thereon which are inserted into a corresponding lowering lever hole 68, thereby allowing lowering lever 90 to rotate with respect to wings 60.

Also illustrated in FIG. 8 is a release pulley 96 linked to stop 100 by using a linkage 98. Release pulley 96 may be recessed into the wing 60 inside of lowering lever hole 68, while linkage 98 runs to, and connects with, stop 100. Linkage 98 may be a small cable which runs from pulley 96 to stop 100, and pulley 96 may further be linked with lower lever 90. For example, lowering lever 90 and pulley 96 may be linked such that as a user pulls upward on lower lever 90, pulley 96 causes linkage 98 to pull on stop 100. Pulling back on stop 100 thereby also engages pin 40 and pulls it away from ramp 28.

This feature is particularly desirable when belay device 10 is in the auto-lock mode and has locked the rope. In particular, to release the rope, the tension on the rope needs to be reduced. When locked, pin 40 engages the rope and pinches it against ramp 28. If a belayer pulls on lowering lever 90, with either hand, however, pulley 96 will pull stop 100, thereby also pulling pin 40, away from ramp 28. The friction on the rope can thereby be decreased, allowing the belayer to release the rope. Depending on the extent to which the belayer pulls on lowering lever 90, the belayer can gradually release the rope.

As will be appreciated in light of the disclosure herein, the ability of the belayer to gradually release the rope can be very desirable. For example, if the climber becomes incapacitated, the belayer can gradually and safely lower the climber to safety. Similarly, a rescue team can gradually lower a rescuer into a ravine or crevice in which a climber is stranded to thereby assist in extricating the climber. In some embodiments, pulley 96 is further spring loaded or otherwise biased such that lowering lever 90 is biased into the position illustrated in FIG. 1, and is kept flush against body 20 and wings 60 when lowering lever 90 is not in use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A belaying device adapted to receive one or more ropes therein, the belaying device comprising:

a main body including a first ramp, a second ramp, and a pin slot having first and second ends, the first end of the pin slot being adjacent the first and second ramps, and the second end of the pin slot being positioned away from the first and second ramps; and a sliding member received at least partially within the pin slot, the sliding member comprising first and second rods that extend at least partially out of opposing sides of the pin slot, the first and second rods being configured to have first and second ropes wrapped respectively thereabout so that the first rope is positioned between the first rod and the first ramp and the second rope is positioned between the second rod and the second ramp, wherein the sliding member is movable between the first and second ends of the pin slot to compress the first rope between the first rod and the first ramp and to compress the second rope between the second rod and the second ramp when the sliding member moves toward the first end of the pin slot, wherein the sliding member is pivotally received within the pin slot such that the distance between the first rod and the first ramp can be larger or smaller than the distance between the second rod and the second ramp in order to accommodate first and second ropes having different characteristics, further comprising at least one cam rotatably linked to the main body, the cam being configured to facilitate positioning of the sliding member in relation to the first and second ramps, wherein the sliding member is movable closer to the first and second ramps when the cam is in a first position than when the cam is in a second position.

2. A belaying device as recited in claim 1, further comprising at least one stop slideably positioned between the sliding member and the cam, wherein the at least one stop is configured to engage the sliding member when the cam is in the second position.

3. A belaying device as recited in claim 1, wherein the sliding member comprises a spherical sleeve disposed within the pin slot, wherein the spherical sleeve enables the sliding member to move between the first and second ends of the pin slot and to pivot within the pin slot.

4. A belaying device as recited in claim 1, wherein the sliding member is configured to facilitate belaying of two ropes having different diameters at the same time.

5. A belaying device as recited in claim 1, wherein the sliding member and the pin slot cooperate to substantially prevent axial movement of the sliding member.

6. A belaying device as recited in claim 1, further comprising:

a first wing rotatably coupled to a first side of the body; and a second wing rotatably coupled to a second side of the body, wherein the first and second wings are configured to facilitate retention of one or more ropes within said belaying device when the one or more ropes are positioned within said belaying device and wrapped around the first or second rods.

7. A belaying device comprising:

a housing including a ramp, wherein the housing is adapted to receive one or more ropes therein such that the one or more ropes are positioned along the ramp; and a sliding member received within the housing, the sliding member being adapted to have the one or more ropes wrapped thereabout such that the one or more ropes can be positioned between the sliding member and the ramp, the sliding member being further adapted to move within the housing and relative to the ramp such that the one or more ropes can be selectively compressed between the sliding member and the ramp, wherein the sliding member is also adapted to pivot within the housing such that a first end of the sliding member is positioned closer to the ramp than a second end of the sliding member so as to accommodate one or more ropes having different physical characteristics, further comprising a cam assembly adapted to change an operational mode of said belay device between an auto-locking mode and a frictional mode.

8. A belaying device as recited in claim 7, wherein pivoting of the first end of the sliding member closer to the ramp than the second end of the sliding member enables a first rope having a first diameter to be compressed between the first end of the sliding member and the ramp at the same time a second rope having a second, larger diameter is compressed between the second end of the sliding member and the ramp.

9. A belaying device as recited in claim 7, wherein pivoting of the sliding member enables substantially simultaneous compression of two ropes having at least one different physical characteristic.

10. A belaying device as recited in claim 7, wherein pivoting of the sliding member enables substantially simultaneous compression of two rope have at least one different physical characteristic, wherein the at least one different physical characteristic between the two ropes is selected from the group consisting of diameter, radial stiffness, frictional coefficient, and a combination thereof.

11. A belaying device as recited in claim 7, wherein said cam assembly comprises a cam rotatably linked to the housing, and at least one stop slidably linked between the cam and the sliding member, wherein the cam and the at least one stop cooperate to regulate the position of the sliding member relative to the ramp.

12. A belaying device as recited in claim 11, wherein said belaying device is in the frictional mode when the cam and the at least one stop maintain a minimum distance between the sliding member and the ramp.

13. A belaying device as recited in claim 11, wherein said belaying device is in the auto-lacking mode when the cam and at least one stop do not maintain a minimum distance between the sliding member and the ramp.

14. A belaying device comprising:

a housing having a longitudinal axis extending from a first end to a second end and being adapted to receive one or more ropes therein, the housing comprising:

a main body having first and second ramps adjacent the second end of the housing such that a first rope can be positioned along the first ramp and a second rope can be positioned along the second ramp, the main body further defining a substantially longitudinal pin slot extending substantially parallel to the longitudinal axis of the housing; and first and second wings rotatably coupled to first and second sides, respectively, of the main body, each of the first and second wings defining a substantially longitudinal channel that is generally parallel to the pin slot; and a rope pin received within the pin slot, the rope pin having first and second rods adapted to extend out of the pin slot such that the first rope can be wrapped around the first rod and be positioned between the first rod and the first ramp, and the second rope can be wrapped around the second rod and be positioned between the second rod and the second ramp, wherein the rope pin can move translationally and pivotally within the pin slot so as to selectively compress the one or more ropes between the rope pin and the first or second ramp, wherein the pivoting movement of the rope pin within the pin slot enables the first rod to be positioned closer to or further away from the first ramp than the position of the second rod relative to the second ramp.

15. A belaying device as recited in claim 14, wherein the rope pin comprises the first and second rods and a spherical sleeve, wherein the spherical sleeve is received within the pin slot of the main body.

16. A belaying device as recited in claim 15, wherein the spherical sleeve cooperates with the pin slot to facilitate translational and pivoting movement of the rope pin within the pin slot, and to prevent axial movement of the rope pin.

17. A belaying device as recited in claim 14, further comprising:

at least one cam rotatably linked to the housing, the cam being configured to facilitate positioning of the rope pin in a first position or a second position relative to the first or second ramp; and a stop slidably received within the channel of each of the first and second wings such that the stops can move within the channels between a first end and a second end of the channels and in a direction generally parallel to the longitudinal axis of the channels, wherein the stops are positioned between the rope pin and the at least one cam such that rotation of the cam causes the stops to move between the first end and the second end of the channels, wherein movement of the stops between the first end and the second end of the channels causes movement of the rope pin between the first position and the second position.

18. A belaying device as recited in claim 14, wherein the pivoting motion capability of the rope pin facilitates substantially simultaneous compression of a first rope between the first rod and the first ramp and a second rope between the second rod and the second ramp even when the first and second ropes have at least one different physical characteristic selected from the group consisting of diameter, radial stiffness, frictional coefficient, or a combination thereof.

* * * * *